US009180451B2

(12) United States Patent
Ziglioli et al.

(10) Patent No.: US 9,180,451 B2
(45) Date of Patent: Nov. 10, 2015

(54) FLUIDIC CARTRIDGE FOR DETECTING CHEMICALS IN SAMPLES, IN PARTICULAR FOR PERFORMING BIOCHEMICAL ANALYSES

(75) Inventors: Federico Giovanni Ziglioli, Pozzo d'Adda (IT); Amedeo Maierna, Albuzzano (IT); Ubaldo Mastromatteo, Bareggio (IT); Gabriele Barlocchi, Cornaredo (IT); Flavio Francesco Villa, Milan (IT)

(73) Assignee: STMicroelectronics S.r.l., Agrate Brianza (IT)

( * ) Notice: Subject to any disclaimer, the term of this patent is extended or adjusted under 35 U.S.C. 154(b) by 1093 days.

(21) Appl. No.: 13/170,058

(22) Filed: Jun. 27, 2011

(65) Prior Publication Data

US 2011/0318840 A1 Dec. 29, 2011

(30) Foreign Application Priority Data

Jun. 28, 2010 (IT) ..... TO2010A0552

(51) Int. Cl.
*B01L 3/00* (2006.01)

(52) U.S. Cl.
CPC ..... *B01L 3/502715* (2013.01); *B01L 2200/027* (2013.01); *B01L 2300/044* (2013.01); *B01L 2300/0636* (2013.01); *B01L 2300/0645* (2013.01); *B01L 2300/0672* (2013.01);
(Continued)

(58) Field of Classification Search
None
See application file for complete search history.

(56) References Cited

U.S. PATENT DOCUMENTS 3,715,911 A 2/1973 Chuan
4,549,427 A 10/1985 Kolesar, Jr.
(Continued)

FOREIGN PATENT DOCUMENTS

EP 0 822 579 A1 2/1998
EP 1 324 382 A1 7/2003
(Continued)

OTHER PUBLICATIONS

D'Amico, A. et al., "Olfactometric Apparatus Based on Oscillating Crystal Sensors Functionalised with Tetrapyrrolic Macrocycles and Provided with Electronics for Conditioning and Reading the Signals, Communicating With a PC, Managing Through a Software and Analysing and Displaying the Data," Italian Patent Application No. RM2001A000455, filed Jul. 26, 2001, 20 pages w/ English translation.
(Continued)

*Primary Examiner* — Yelena G Gakh
*Assistant Examiner* — Michelle Adams
(74) *Attorney, Agent, or Firm* — Seed IP Law Group PLLC

(57) ABSTRACT

A fluidic cartridge for detecting chemicals, formed by a casing, hermetically housing an integrated device having a plurality of detecting regions to bind with target chemicals; part of a supporting element, bearing the integrated device; a reaction chamber, facing the detecting regions; a sample feeding hole and a washing feeding hole, self-sealingly closed; fluidic paths, which connect the sample feeding and washing feeding holes to the reaction chamber; and a waste reservoir, which may be fluidically connected to the reaction chamber by valve elements that may be controlled from outside. The integrated device is moreover connected to an interface unit carried by the supporting element, electrically connected to the integrated device and including at least one signal processing stage and external contact regions.

18 Claims, 9 Drawing Sheets

(52) U.S. Cl.
CPC .. *B01L2300/0816* (2013.01); *B01L 2300/0867* (2013.01); *B01L 2300/1827* (2013.01); *B01L 2400/0439* (2013.01); *Y10T 436/11* (2015.01)

(56) References Cited

U.S. PATENT DOCUMENTS

| | | | | |
|---|---|---|---|---|
| 5,018,395 | A | 5/1991 | Hickox et al. | |
| 5,469,369 | A | 11/1995 | Rose-Pehrsson et al. | |
| 5,692,279 | A | 12/1997 | Mang et al. | |
| 6,085,576 | A | 7/2000 | Sunshine et al. | |
| 6,196,051 | B1 | 3/2001 | Marshall et al. | |
| 6,448,695 | B2 | 9/2002 | Milsom | |
| 6,467,332 | B1 | 10/2002 | Bertschi et al. | |
| 6,883,364 | B2 | 4/2005 | Sunshine et al. | |
| 6,933,807 | B2 | 8/2005 | Marksteiner et al. | |
| 7,071,073 | B2 | 7/2006 | Villa et al. | |
| 7,294,536 | B2 | 11/2007 | Villa et al. | |
| 2003/0062807 | A1 | 4/2003 | Takeuchi et al. | |
| 2004/0055363 | A1 | 3/2004 | Bristol | |
| 2004/0132059 | A1 | 7/2004 | Scurati et al. | |
| 2004/0172798 | A1 | 9/2004 | Ruby et al. | |
| 2005/0208696 | A1 | 9/2005 | Villa et al. | |
| 2005/0233440 | A1 | 10/2005 | Scurati et al. | |
| 2006/0019273 | A1 | 1/2006 | Connolly et al. | |
| 2006/0125489 | A1 | 6/2006 | Feucht et al. | |
| 2006/0160205 | A1* | 7/2006 | Blackburn et al. | 435/287.2 |
| 2006/0216812 | A1 | 9/2006 | Okada et al. | |
| 2006/0257286 | A1 | 11/2006 | Adams | |
| 2010/0107739 | A1 | 5/2010 | Marra | |
| 2010/0163410 | A1 | 7/2010 | Mastromatteo et al. | |
| 2010/0170324 | A1 | 7/2010 | Mastromatteo et al. | |
| 2011/0209524 | A1 | 9/2011 | Ziglioli et al. | |
| 2012/0168882 | A1 | 7/2012 | Cherian et al. | |
| 2012/0171713 | A1 | 7/2012 | Cherian et al. | |
| 2012/0171774 | A1 | 7/2012 | Cherian et al. | |
| 2012/0286381 | A1 | 11/2012 | Ziglioli | |

FOREIGN PATENT DOCUMENTS

| | | | |
|---|---|---|---|
| EP | 1 403 383 | A1 | 3/2004 |
| EP | 1 246 699 | B1 | 1/2007 |
| IT | RM2001A000455 | | 7/2001 |
| WO | 01/57813 | A2 | 8/2001 |

OTHER PUBLICATIONS

Richter, M. et al., "A High Performance Silicon Micropump for Fuel Handling in DMFC Systems," proceedings of the Fuel Cell Seminar, Miami Beach, FL, USA, pp. 272-275, Nov. 3-7, 2003.

Federico Giovanni Ziglioli et al., "Integrated Chemical Sensor for Detecting Odorous Matters," U.S. Appl. No. 13/016,086, filed Jan. 28, 2011, 27 pages.

Benetti et al., "Chemical Sensor Based on Thin Film Bulk Acoustic Wave Resonator (TFBAR)," Proceedings of the 10th Italian Conference on Sensors and Microsystems, Firenze, Italy, pp. 326-331, Feb. 15-17, 2005.

Hwang et al., "CMOS VLSI Potentiostat for Portable Environmental Sensing Applications," *IEEE Sensors Journal 10*(4):820-821, Apr. 2010.

Matsumoto et al., "Influence of Underlayer Materials on Preferred Orientations of Sputter-Deposited AlN/Mo Bilayers for Film Bulk Acoustic Wave Resonators," *Japanese Journal of Applied Physics 43*(12):8219-8222, 2004.

Rosenbaum, "Bulk Acoustic Wave Theory and Devices," Boston, MA: Artech House, 1988, 7 pages.

Schienle et al., "A Fully Electronic DNA Sensor With 128 Positions and In-Pixel A/D Conversion," IEEE Journal of Solid-State Circuits 39(12):2438-2445, Dec. 2004.

Turner et al., "A CMOS Potentiostat for Amperometric Chemical Sensors,"*IEEE Journal of Solid-State Circuits, SC-22*(3):473-478, Jun. 1987.

Yang et al., "Amperometric Electrochemical Microsystem for a Miniaturized Protein Biosensor Array," *IEEE Transactions on Biomedical Circuits and Systems 3*(3):160-168, Jun. 2009.

Zhang et al., "Electrochemical Array Microsystem with Integrated Potentiostat," *IEEE Sensors*, pp. 385-388, 2005.

* cited by examiner

FLUIDIC CARTRIDGE FOR DETECTING CHEMICALS IN SAMPLES, IN PARTICULAR FOR PERFORMING BIOCHEMICAL ANALYSES

BACKGROUND

1. Technical Field

The present disclosure relates to a fluidic cartridge for detecting chemicals in samples, in particular for performing biochemical analyses.

2. Description of the Related Art

As is known, the demand for microsensors of small dimensions has led to the study of integrated solutions that use the techniques and the knowledge acquired in the manufacture of semiconductors. In particular, detection and diagnostic devices of a disposable type, which may be connected to external apparatuses for chemical and biochemical analyses, have been studied.

Detection and diagnostic devices of a known type basically comprise a solid substrate, generally of a flat type, bearing a chip, whereon particular receptors, such as for example biomolecules (DNA, RNA, proteins, antigens, antibodies, etc.), micro-organisms or parts thereof (bacteria, viruses, spores, cells, etc.) are fixed, or a sensitive layer extends that is able to bind with the chemical to be detected, for example a metal-porphyrin having affinity with the target chemical.

BRIEF SUMMARY

One embodiment is a cartridge for the analysis of samples dissolved in a liquid with a closed system that integrates both the electronic functions and the fluidic management of the sample to be analyzed, of possible other reagents, and of further liquids that may be used, such as washing and cleaning liquids.

BRIEF DESCRIPTION OF THE SEVERAL VIEWS OF THE DRAWINGS

For a better understanding of the present disclosure, preferred embodiments thereof are now described, purely by way of non-limiting example, with reference to the attached drawings, wherein.

DETAILED DESCRIPTION

Figure 1:
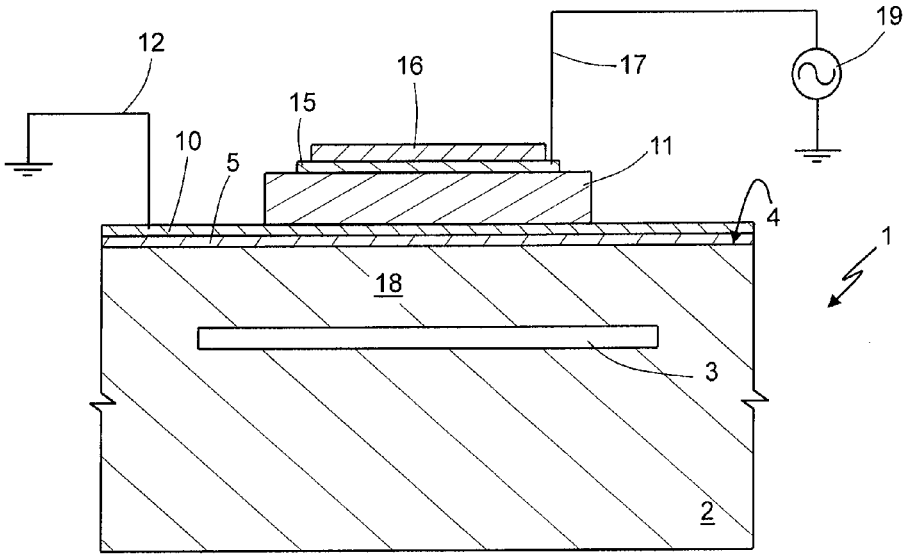
FIG. 1 is a cross-section through a silicon wafer integrating an electronic-microbalance cell forming the subject of patent applications discussed below.

Detection of target chemicals may be performed in different ways, in particular in an optical or electrical or chemical way. For example, U.S. Patent Publication No. 2010/0170324 describes an electronic nose that is able to detect the presence of one or more substances dispersed in the surrounding environment via piezoelectric microbalances obtained with MEMS (Micro-Electro-Mechanical-System) technology and integrated in a semiconductor chip.

The microbalances form part of an electronic resonator and each bear a respective sensitive region. Following the chemical reaction between the target chemicals and the sensitive layer of each microbalance, the mass of the microbalance is varied, thus altering the oscillating frequency of the resonator. This variation of frequency is detected by a circuit in the chip, which outputs corresponding electrical signals indicating the detection of one or more chemicals. In practice, the microbalances form an array of chemical sensors, which have different selectivity levels and supply electrical signals defining a characteristic mapping of a chemical mixture to be detected. The electrical signals are then used by the external analysis apparatus, which classifies them on the basis of the knowledge acquired in a learning step of the system so as to identify the substance or mixture detected.

For example, U.S. Patent Publication No. 2010/01663410 describes a device for electronic detection of biological materials that uses the sensor forming the electronic nose described above.

This type of sensor has, among its most promising applications, biomedical applications in so far as it enables detection of molecules resulting from biological processes that are indicators of pathological states; for example it may detect the presence of *Escherichia coli*.

Furthermore, the sensor may be used for detecting the presence of chemical species produced by bacteria. For example, in environmental applications, the sensor may be used for detecting the presence of cyano bacteria present in bodies of water and watercourses.

The sensor may be also used in the foodstuff and fishing industry for recognition of the quality and freshness of the products, for the identification of fraud (control of origin, adulteration), of contaminants, as well as in the cosmetics industry and wine industry.

It is possible to carry out the chemical analyses described both on samples dispersed in a gaseous volume and on samples dissolved in a liquid. In the latter case, the substrate with the chip may be inserted in a fluidic "cartridge" having the task of confining and treating the sample to be analyzed.

However the chemical sensors present on the market do not completely meet the various requirements of the specific applications. In fact:

1. they are single-layer devices typically of plastic or vitreous material that handle the fluids on just one plane and confine the samples in appropriate areas for the reactions or for reading; consequently, the samples are to be handled with manual procedures, which are subject to error and may entail contamination;

2. they do not manage integrated functions, which may typically be implemented via electronic chip, such as detection functions and heating functions;

3. they are not closed systems, in so far as the liquids move in the open on the surfaces of the disposable module and are thus subject to contamination from outside;

4. they do not integrate the reservoirs for containing washing liquids, but require the immersion of the disposable module in ovens or the like, potentially releasing pollutant fractions of the liquid content into the environment.

Some of the problems presented above are solved by the device for electronic detection of biological materials described in U.S. Patent Publication No. 2010/0163410 cited above. In this application, the semiconductor material chip forming the microbalances integrates also a thermostatting system using resistors as well as other integrated electronic functions for detection.

Furthermore, U.S. Patent Publication No. 2011/0209524 describes a cartridge housing the electronic nose chip referred to above, which forms a closed system for transport, analysis, and discharge of substances contained in a gas to be analyzed and may be directly connected to an external analysis apparatus for evaluating the results.

Hereinafter embodiments are described of a cartridge 35, 135 that is able to perform analyses for detecting chemicals present in a sample. The cartridge described here is a system basically made up of the following functional modules:

- a supporting element for the electronic and electromechanical components, for example a printed circuit;
- a detection unit, integrated in a chip fixed to the supporting element; the detection unit integrates a plurality of microbalances treated with material sensitive to the target, and possible electronic components co-operating with the microbalances;
- an interface unit, for example integrated in one or more integrated devices fixed to the supporting element; the interface unit may comprise hardware-software stages that generate, transfer, and filter measurement signals, control signals, and power exchanged between the detection unit and an external analysis apparatus; and
- a casing, which encloses completely the detection unit and partially the supporting element and/or the interface unit to enable electrical connection with the external analysis apparatus.

The detection unit that may be used in the cartridge described hereinafter may be manufactured as disclosed in the above U.S. patent application Ser. Nos. 12/648,996 and 12/649,019, and described herein briefly with reference to FIGS. 1-3.

In detail, FIG. 1 shows a cell 1 integrated in a body 2 of semiconductor material, for example monocrystalline silicon, having a surface 4 and a buried cavity 3, which delimits a bottom of a membrane 18, also of monocrystalline silicon.

A buffer layer 5, for example of aluminum nitride (AlN), extends on top of the membrane 18, and a bottom electrode 10, for example of molybdenum, extends on top of the buffer layer 5. Here, the buffer layer 5 may have a thickness comprised between 30 and 100 nm, for example 50 nm, and the bottom electrode 10 may have a thickness comprised between 50 and 150 nm, for example 100 nm.

A piezoelectric region 11 extends on top of the bottom electrode 10, and has here a smaller area than the electrode 10 so as to enable electrical connection of the bottom electrode 10, as represented by the wire 12, to a ground potential. The piezoelectric region 11 may have a thickness of between 1 and 3 μm, for example approximately 2 μm.

A top electrode 15, which is also for example of molybdenum and has a thickness comprised between 50 and 150 nm, for example 100 nm, extends on top of the piezoelectric region 11. The top electrode 15 may have the same area as or an area smaller than the piezoelectric region 11 and is connected, for example by a wire 17, to an oscillator 19, of a known type and not illustrated in detail.

Finally, a sensitive region 16 extends on top of the top electrode 15. The sensitive region 16 is of a material able to bind with the chemical to be detected, in particular a metal-porphyrin having affinity with this chemical. Finally, a passivation layer (not illustrated) may be deposited outside the sensitive region 16 and opened to form the contacts (not illustrated).

The circuit formed by the piezoelectric region 11 and by the oscillator 19 forms an electronic resonator having a natural oscillating frequency. When a target substance binds to the sensitive region 16, the resonator undergoes an oscillating frequency variation $\Delta f$. By measuring the frequency variation, it is possible to recognize whether target chemicals, bound selectively to the sensitive region or regions 16, have been adsorbed. From the mass variation, it is moreover possible to derive the amount of the adsorbed substances.

Figure 2:
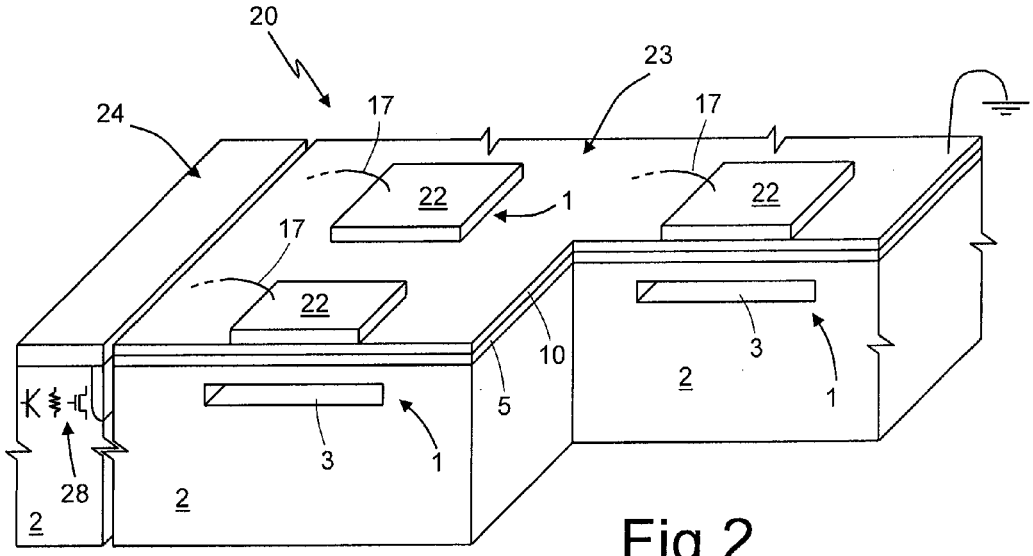
FIG. 2 is a partially sectioned perspective view of a chip integrating a plurality of cells of FIG. 1.

FIG. 2 shows a silicon chip 20, having a sensitive portion 23 and a circuitry portion 24. The sensitive portion 23 integrates a plurality of cells 1, for example eight (only three of which are visible), sensitive to the same chemical or to other chemicals; the circuitry portion 24 integrates electronic components of an associated electronics 28. In FIG. 2, the cells 1 are represented schematically, each including a detecting region 22 representing the ensemble of the regions 11, 15 and 16 of FIG. 1. Furthermore, the bottom electrode 10 coats the entire shown surface of the cells 1 area, and the wires 17 are connected to appropriate external areas. Alternatively, the bottom-electrode layer 10 may be defined so as to form contact pads and interconnection lines towards the associated electronics 28.

In practice, the cells 1 are arranged in an array so as to be able to recognize each a same or a different chemical, and the electrical signals generated, after being treated, may be compared with known distributions in order to recognize individual chemicals or mixtures.

Figure 3:
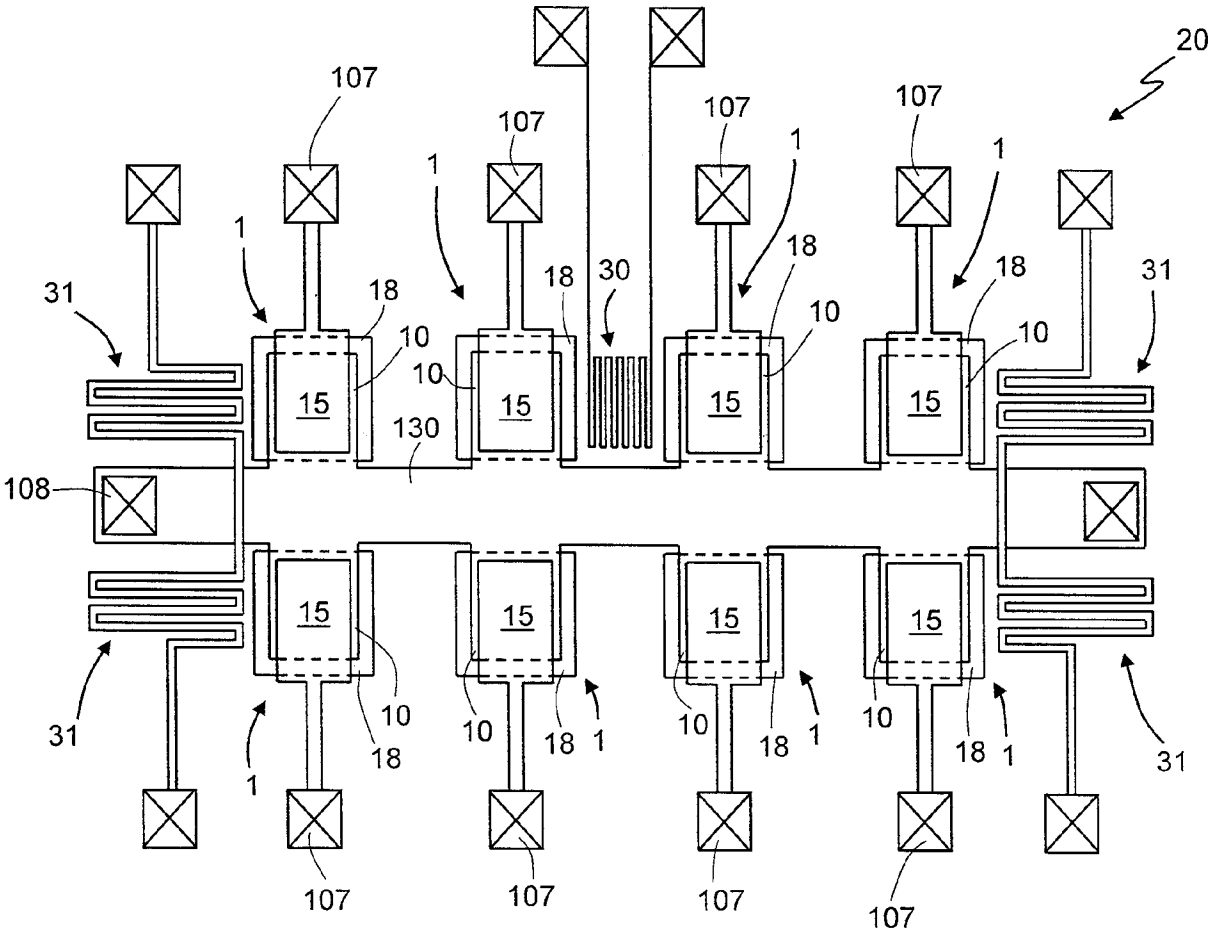
FIG. 3 shows a top plan view of the arrangement of the cells in the chip of FIG. 2.
Figure 4:
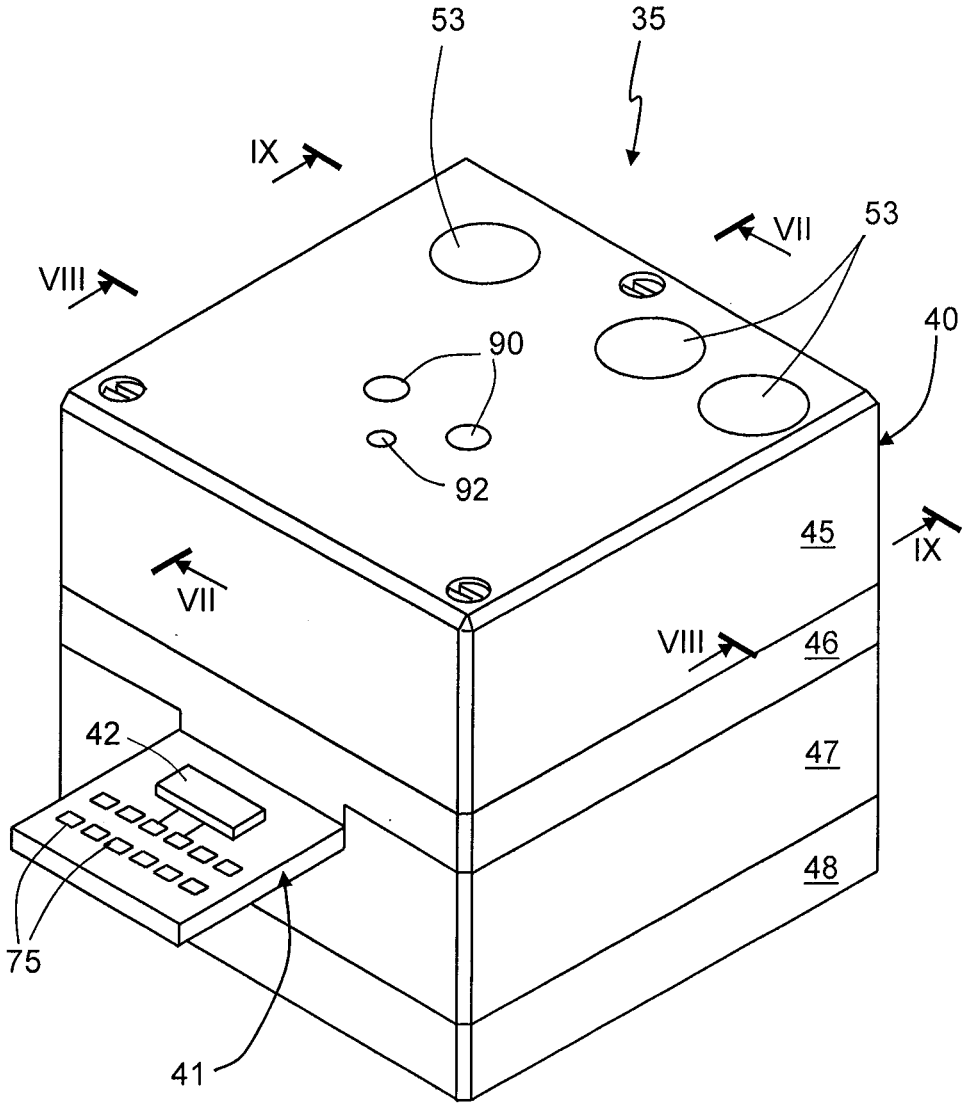
FIG. 4 is a perspective view of an embodiment of the present cartridge.
Figure 5:
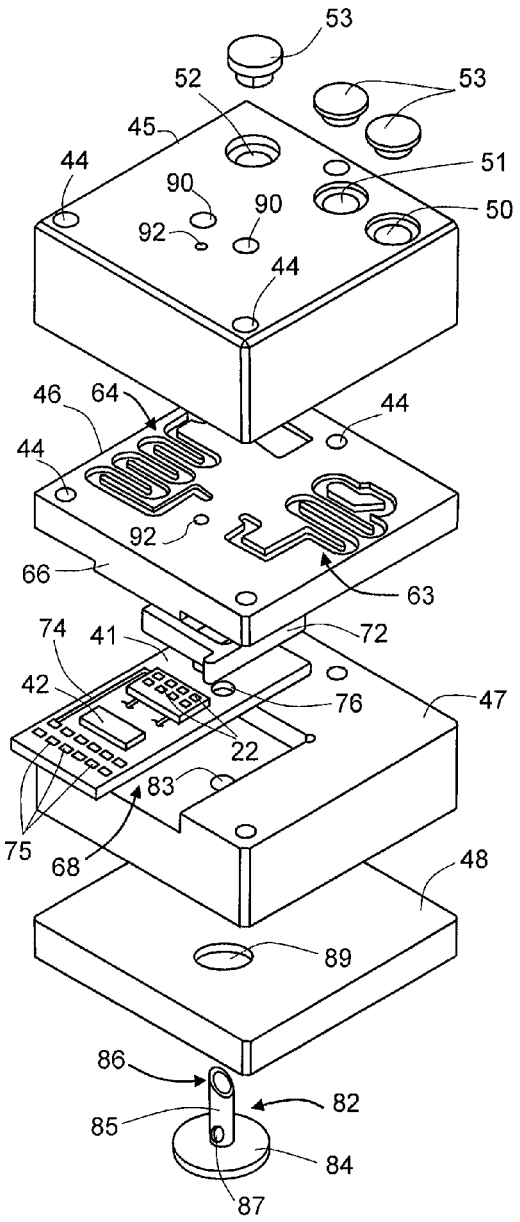
FIGS. 5 and 6 are, respectively, a top and a bottom exploded view of the cartridge of FIG. 4.
Figure 6:
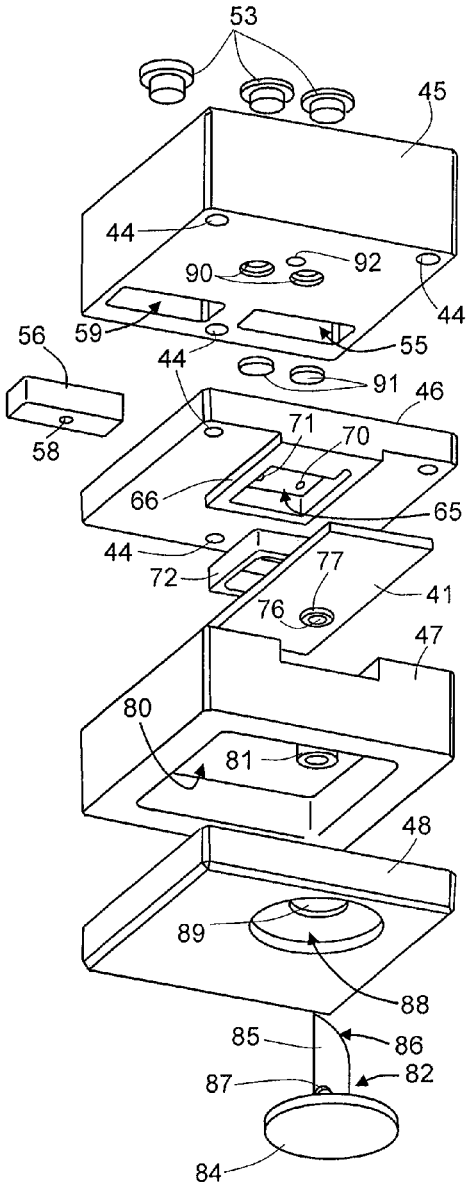
Figure 7:
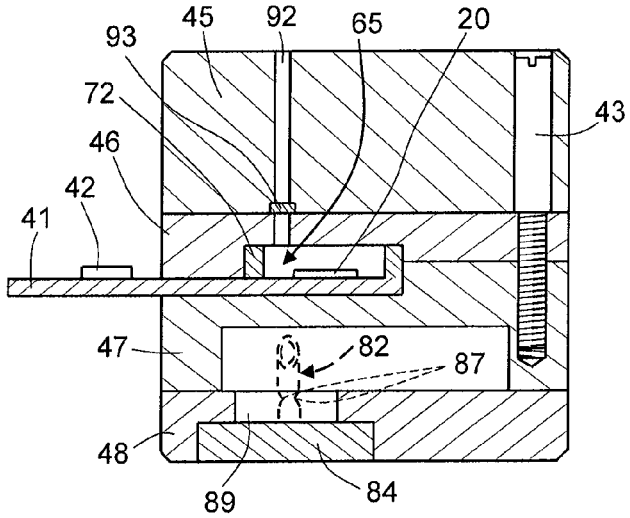
FIG. 7-9 are cross-sections of the cartridge of FIG. 4, taken, respectively, along the section planes VII-VII, VIII-VIII and IX-IX.
Figure 8:
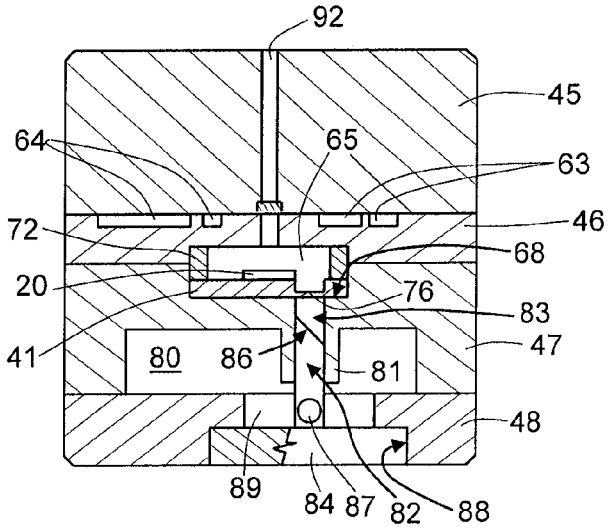
Figure 9:
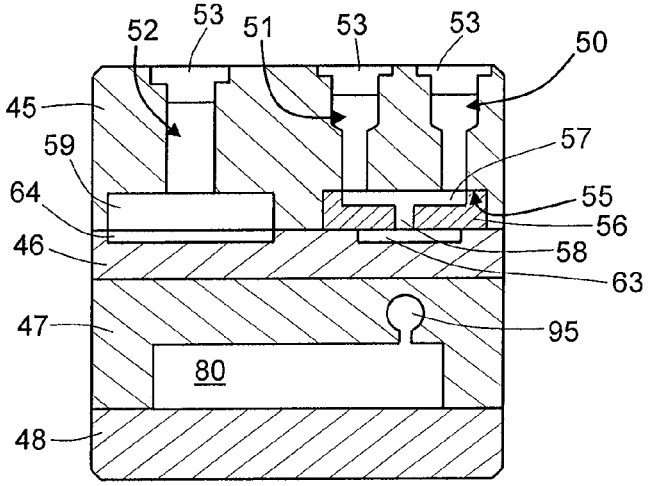

FIG. 3 shows a top plan view of the sensitive portion 23 of the chip 20 of FIG. 2. Each cell 1 has an own top electrode 15 connected to an own contact 107 and overlying an own membrane 18. The bottom electrodes 10 of the cells 1 are connected together by a connection line 130, in turn connected to contacts 108. Heaters 31 are formed alongside the microbalances 1, for example by aluminum coils, in the same metallization level as the contacts 107, 108. At least one temperature sensor 30 is formed in the sensitive area 23, for example in the central portion of the latter, in the same metallization level as the contacts 107, 108 and as the heaters 31, for example of aluminum.

FIGS. 4-9 show an embodiment of a cartridge 35 having a casing 40 of a closed type, housing part of a supporting element 41 bearing the chip 20 as well as microfluidic components useful for introducing, transferring, mixing, and containing the samples, as well as for washing and for collecting the washing liquids. The supporting element 41 moreover bears an interface 42 electrically connected to the chip 20.

In detail, the casing 40 is formed by a parallelepiped body of plastic material, for example of transparent polycarbonate, from a side whereof protrudes part of the supporting element 41. The casing 40 is formed by four superimposed layers, including a top closing layer 45, a fluidic layer 46, a bearing layer 47, and a bottom closing layer 48. The layers 45-47 are fixed together for example by three screws 43, which engage threaded holes 44 and/or by bonding or heat-sealing; the layers 47-48 are, for example, bonded.

In detail, the top closing layer 45 has three feeding holes 50-52, respectively for a sample to be examined, for reagents, and for a washing liquid, closed at the top by respective breakable plugs 53 of self-sealing material, such as silicone.

Figure 10:
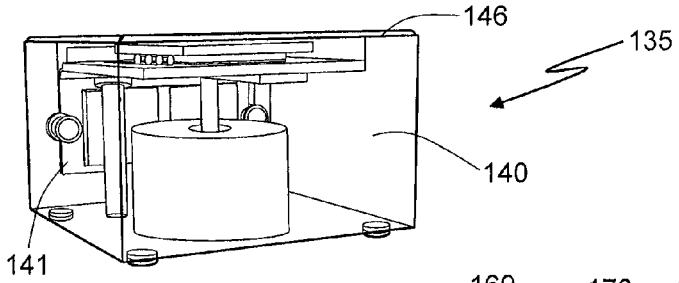
FIG. 10 is a perspective view of a different embodiment of the present cartridge.
Figure 14:
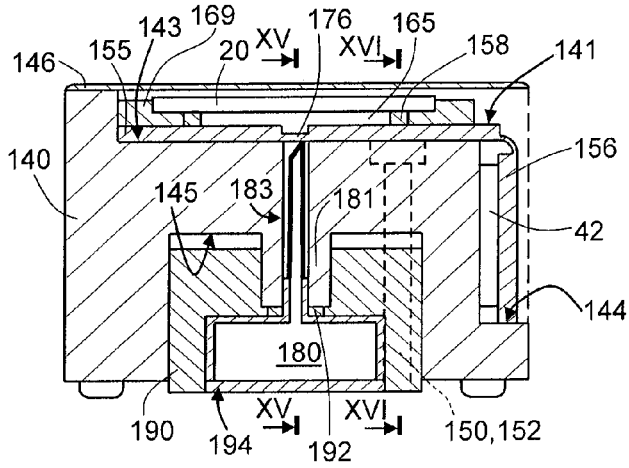
FIGS. 14-16 are cross-sections taken, respectively, along section planes XIV-XIV, XV-XV and XIV-XIV.
Figure 15:
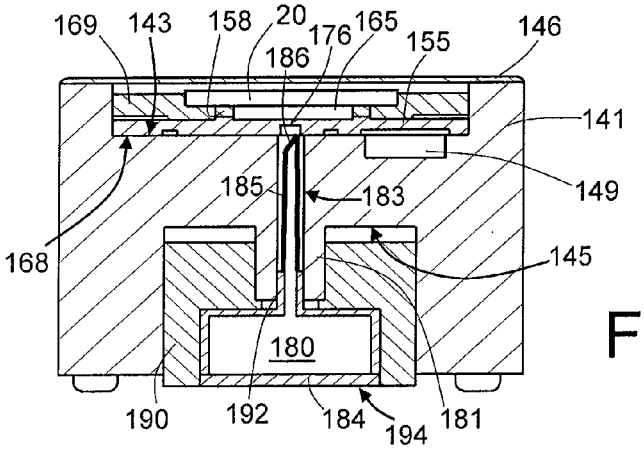

The feeding holes 50, 51, for the sample to be examined and for the reagents, extend from the top side of the top closing layer 45 and end into a premixing cavity 55 housing a premixing body 56. This body (FIG. 10) in turn has a surface groove 57, where the first and second feeding holes 50, 51 end, and a connection opening 58, which extends from the surface groove 57 to the bottom side of the premixing body 56.

The feeding hole 52 for the washing liquid extends from the top side of the top closing layer 45 and ends into a washing cavity 59 that opens on the bottom side of the top closing layer 45.

The fluidic layer 46 is relatively flat and has a top surface, in contact with the top closing layer 45, which is etched so as to define a first fluidic channel 63 and a second fluidic channel 64, and a bottom surface, in contact with the bearing layer 47, having a protrusion 66, wherein a reaction chamber 65 is formed. In detail, the first fluidic channel 63 has a first end at the connection opening 58 of the premixing body 56 and a second end at a through hole 70 (FIG. 6), the latter traversing the fluidic layer 46 and connecting the first fluidic channel 63 to the reaction chamber 65. The second fluidic channel 64 has a first end at the washing channel 59 and a second end at a through hole 71 (FIG. 6), the latter traversing the fluidic layer 46 and connecting the second fluidic channel 64 to the reaction chamber 65. The fluidic channels 63, 64 are etched in the top surface of the fluidic layer 46 and define coils for favoring mixing of the fluids and/or their heating via resistors (not illustrated) extending along the path of the fluidic channels 63, 64.

The protrusion 66 extends from the front side of the casing 40; the supporting element 41 protrudes from the same front side towards the inside for more than one half of the length of the casing 40, and concurs, together with a corresponding cavity 68 in the bearing layer 47, in defining a housing for the supporting element 41. To this end, the protrusion 66 has a width (in a direction parallel to the front side of the casing 40) equal to that of the supporting element 41 and a length (towards the inside of the casing 40) equal to the length of the internal portion of the supporting element 41. Furthermore, the height of the protrusion 66 is equal to the depth of the cavity 68 minus the thickness of the supporting element 41, so as to firmly clamp the supporting element 41 in position. A gasket 72 of a generally square annular shape housed within the reaction chamber 65 and resting against the side walls of the latter hermetically closes the reaction chamber 65 on the sides, guaranteeing, in use, liquid-tightness within the reaction chamber 65.

Figure 17:
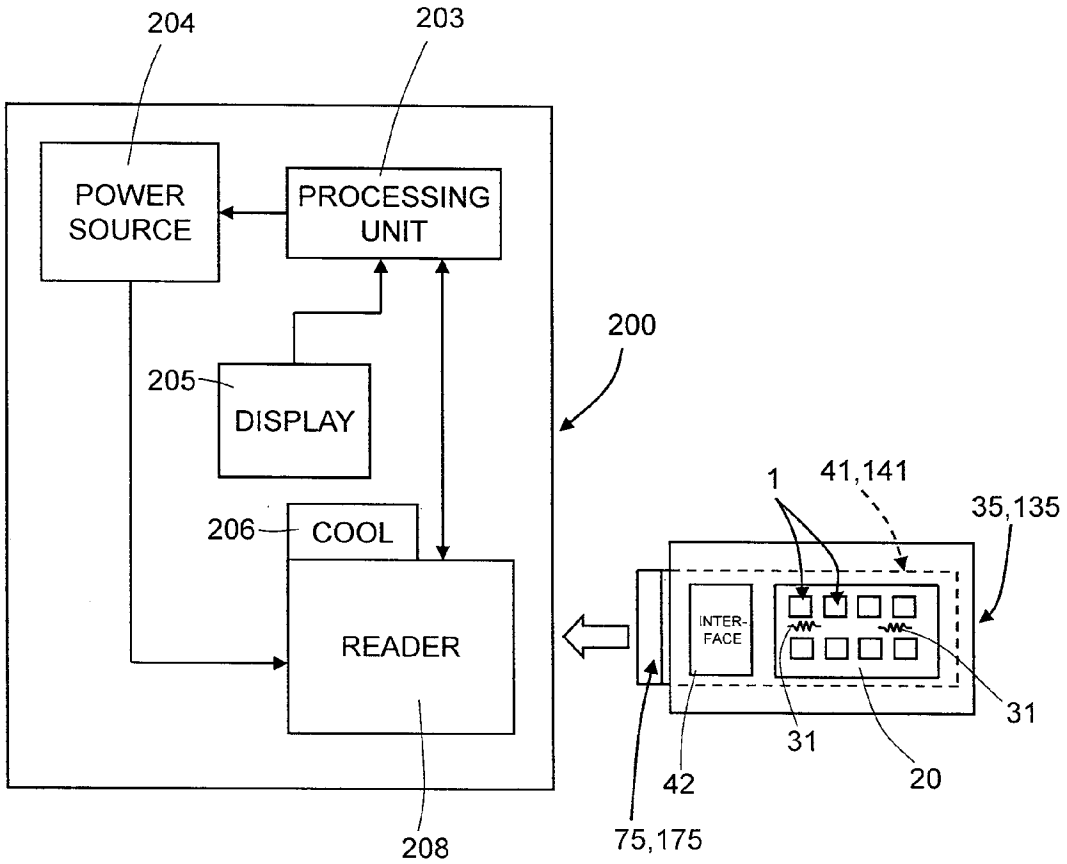
FIG. 17 is a simplified block diagram of an apparatus for analyzing samples that uses a disposable cartridge illustrated in FIGS. 4-16.

The chip 20 is fixed to the supporting element 41 so as to be positioned within the reaction chamber 65, with the detecting regions 22 facing the chamber 65. Instead, the interface 42 is fixed in a portion of the supporting element 41 external to the casing 40; alternatively, it may also be housed within the supporting element 41, outside the reaction chamber 65. Moreover, conductive paths 74 are provided on the supporting element 41 for electrically connecting the chip 20 and the interface 42 to contacts or pads 75 arranged on the outer end of the supporting element 41, for connection to an external analysis apparatus (FIG. 17).

The supporting element 41 has a membrane diaphragm 76 facing the reaction chamber 65. The membrane diaphragm 76 may be formed by a weakened portion of the supporting element 41 so that it may be broken, during use, for discharging the liquid present in the reaction chamber 65, as explained in greater detail hereinafter. For example, if the supporting element is manufactured as a printed circuit of a flexible type, with a core layer, for example of FR4, Kapton, polyimide or Teflon, coated with appropriate finishing materials, the membrane diaphragm 76 may be obtained via a thinner portion of the core layer, with a thickness of 20-100 μm. Alternatively, the membrane diaphragm 76 may be formed by a breakable silicone element.

A gasket ring 77 may be arranged on the side of the supporting element 41, facing the bearing layer 47, surrounding the membrane diaphragm 76 and manufactured from a metallization layer coated with solder mask, thus creating a protruding gasket that ensures liquid-tightness in the discharge and washing step, as discussed in greater detail hereinafter.

The bearing layer 47 functions also as a waste reservoir. To this end, it has, on its side facing the bottom closing layer 48, a waste chamber or reservoir 80. The waste chamber 80 extends for a fair share of the thickness of the bearing layer 47, for example one half, underneath the reaction chamber 65 and the membrane diaphragm 76, and has a through connection hole 83, which is aligned to the membrane diaphragm 76 and extends between the cavity 68 and the waste chamber 80. A guide wall 81, with a cylindrical shape, extends within the waste chamber 80, substantially aligned to the through connection hole 83 and to the membrane diaphragm 76 for guiding a perforating element 82.

The perforating element 82 comprises a hollow shaft 85, having, for example, a cylindrical shape, cut obliquely at one end so as to form a perforating tip 86. Peripheral openings 87 in the hollow shaft 85 fluidically connect the inside of the hollow shaft 85 to the waste chamber 80. The hollow shaft 85 is fixed with respect to a disk-shaped button 84 of a deformable material (for example, an elastomer), which is housed in an actuator cavity 88, counter-shaped with respect to the actuator button 84, formed in the bottom closing layer 48 and facing the outside of the casing 40. The actuator cavity 88 is connected to an actuator hole 89 that traverses the bottom closing layer 48 and has a diameter smaller than the actuator cavity 88. The hollow shaft 85 of the perforating element 82 extends from the actuator button 84, through the actuator hole 89 and the waste chamber 80, as far as within the cylindrical guide wall 81. In particular, the perforating tip 86 of the hollow shaft 85 protrudes towards the membrane diaphragm 76 at a short distance therefrom in such a way that, by manually or automatically pushing the actuator button 84 (which, as has been said, is of elastically deformable material) inwards, this undergoes deformation, causing advance of the hollow shaft 85, so that the perforating tip 86 reaches and perforates the membrane diaphragm 76, setting the reaction chamber 65 in fluidic connection with the waste chamber 80 and enabling discharge of the waste by gravity.

In practice, the perforating element 82 and the membrane diaphragm 76 form a valve that may be controlled just once by an actuator element, initially closed so as to seal the reaction chamber 65 at the bottom, and subsequently opened for discharging the waste into the waste chamber 80.

Finally, the casing 40 has a series of aeration holes and chambers. In particular, a pair of aeration holes 90 extend through the top closing layer 45 up to the fluidic channels 63, 64 to enable exit, in use, of the air contained in these channels while introducing the samples and the reagents. Diaphragms 91, of a hydro-repellent fabric, for example GORE-TEX®, close the aeration holes 90 at the bottom and enable passage of air but not of liquids. A chamber-aeration hole 92 extends through the top closing layer 45 and the fluidic layer 46 and ends into the reaction chamber 65 to enable venting of this chamber when it is filled with the mixture of the liquid sample and of the reaction liquid. Here, a diaphragm 93 (FIGS. 7 and 8) arranged between the top closing layer 45 and the fluidic layer 46 normally closes the chamber-aeration hole 92. The waste chamber 80 is connected to an aeration opening 95, which extends into the bearing layer 47 and opens towards the rear side of the casing 41 (opposite to the one from which the supporting element 41 protrudes) for outflow of air during discharge of the liquids. Also in this case, a diaphragm (not illustrated) normally closes the aeration opening 95 at the rear wall of the casing 40 and enables the aeration opening 95 to operate as buffer, without any risk of contamination towards/from the outside.

In this way, the casing 404 forms a closed device that practically eliminates the possibility of biological pollution of the surrounding environment as well as the possibility of contamination of the samples to be analyzed.

In fact, the liquid or gaseous sample to be examined may be introduced into the sample feeding hole 50 through a syringe that traverses the respective breakable plug 53. Thanks to the elasticity of the material, this closes again the perforation point as soon as the needle is extracted. Likewise, the reagents are introduced into the reagent feeding hole 51 using a syringe.

The sample and the reagents are pre-mixed inside the pre-mixing body 56 and subsequently undergo an accurate mixing in the fluidic channel 63, from which, through the through hole 70, they reach the reaction chamber 65. Transport of the material from the feeding holes 50, 51 to the reaction chamber 65 occurs as a result of the pressure applied in the feeding holes 50-51 with the syringe or also in just one of these, by virtue of the self-sealing characteristics of the breakable plugs 53.

In the reaction chamber 65, the mixed material is in contact with the detecting regions 22, already functionalized, with which it may react. The reaction may be favored using thermal cycles performed via the heaters 31, controlled by the electronics integrated in the chip 20, by the interface 42, or by the external analysis apparatus.

During the mixing step and/or during the reaction step, a sonotrode ultrasound generator may irradiate the concerned areas to favor the operations, since the polycarbonate casing 40 enables a good transfer of ultrasound towards the internal volumes.

At the end of the time envisaged for the reaction (e.g., after 5-60 min), the membrane diaphragm 76 is perforated, causing the liquid reagents to flow away into the waste chamber 80.

To this end, the operator controls or actuates the perforating element 82. As a result of the compliance of the actuator button 84, the hollow shaft 85 translates within the guide wall 81 and perforates the membrane diaphragm 76, enabling the liquid to flow away, by gravity, within the hollow shaft 85 and, through the peripheral openings 84, into the waste chamber 80.

Next, a washing liquid is introduced through the washing feeding hole 52. Also in this case, charging may be performed via a syringe, which perforates the self-sealing plug 53, also via successive injection of different liquids, which are mixed in the fluidic path, in particular in the second fluidic channel 64. Also here, the transport of the washing liquid or liquids occurs as a result of the pressure applied with the syringe so as to cause the washing liquids to advance in the second fluidic channel 64, in the through hole 71 and thus into the reaction chamber 65. Then the washing liquid is discharged into the waste chamber 80 which is in connection with the reaction chamber 65 as a result of the perforation of the membrane diaphragm 76 and of the hollow shaft 85 even if the perforating element has returned into the resting position.

Alternatively, the washing liquid may be introduced into the reaction chamber 65 before the membrane diaphragm 76 is opened and the fluid present in the reaction chamber is discharged into the waste chamber 80.

In either case, the washing liquid with the residue of the sample and of the reagents remains enclosed within the casing, thanks also to the elasticity of the actuator button 84, which resumes its shape as soon as the pressure exerted by the operator or by the external analysis apparatus in which the cartridge 35 is inserted ceases.

FIGS. 10-16 show a different embodiment of the present cartridge (here designated by 135), where the supply channels for the sample, the reagents, and the washing liquid are formed all in the bottom part of the cartridge 135. The cartridge 135 thus has a minimal height.

Figure 16:
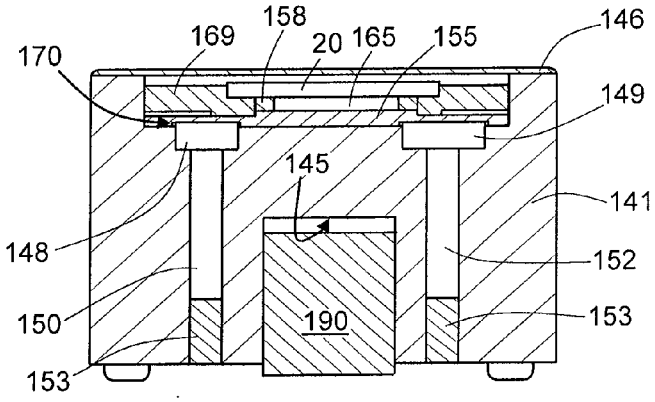

In detail, the cartridge 135 comprises a monolithic and substantially parallelepiped casing 140, for example having a square base of 6.6×6.6 cm and a height of 4 cm. The casing 140 has at the top a first recess 143 with a parallelepiped shape and an area a little smaller than the area of the base of the casing, closed at the top by a cover 146. The first recess 143, which has a height much smaller than the casing, for example equal to 0.5 cm, is connected to a second recess 144, also of a parallelepiped shape, formed on a vertical side of the casing 140, and extends for a fair share of the height of the casing 140 (FIG. 16). The recesses 143 and 144 form in practice a seat with L-shaped cross-section for a supporting element 141 for the electronic and electromechanical components, as described in greater detail below.

The casing 140 has at the bottom an actuator cavity 145, having a cylindrical shape and open downwards, into which a guide wall 181 with a cylindrical shape protrudes as a continuation of a through connection hole 183, which extends from the actuator cavity 145 up to the first recess 143. Furthermore, a first feeding hole 150 and a second feeding hole 152 extend from the bottom side of the casing 141 up to the first recess 143, for supplying a sample to be examined and a washing liquid. The feeding holes 150, 152 are closed at the bottom by respective breakable plugs 153 and are widened at their top end so as to form top chambers 148, 149.

The supporting element 141 is here formed by two parts: a first board 155, for supporting the chip 20, and a second board 156, for supporting the interface 42, connected together along a flexible stretch 157 of the supporting element 141 so as to lie in two perpendicular planes. In particular, the first board 155 is housed in the first recess 143 and the second board 156 is housed in the second recess 144. The supporting element 141 may be obtained according to the technique used for printed circuits, with a core of flexible polymeric material (e.g., Rigid-flex) and coating layers, for example, of solder-mask copper, suitably shaped so as to enable bending of the flexible stretch 157, to form conductive paths and regions (not illustrated) and define grooves and areas for fluid treatment, as illustrated in the enlarged details of FIG. 12 and explained below. In this way, the thin flexible core of the supporting element 141, with a thickness of between 20 and 100 μm, may be bent at 90° to form the first and second boards 155, 156 and the flexible stretch 157.

Figure 12:
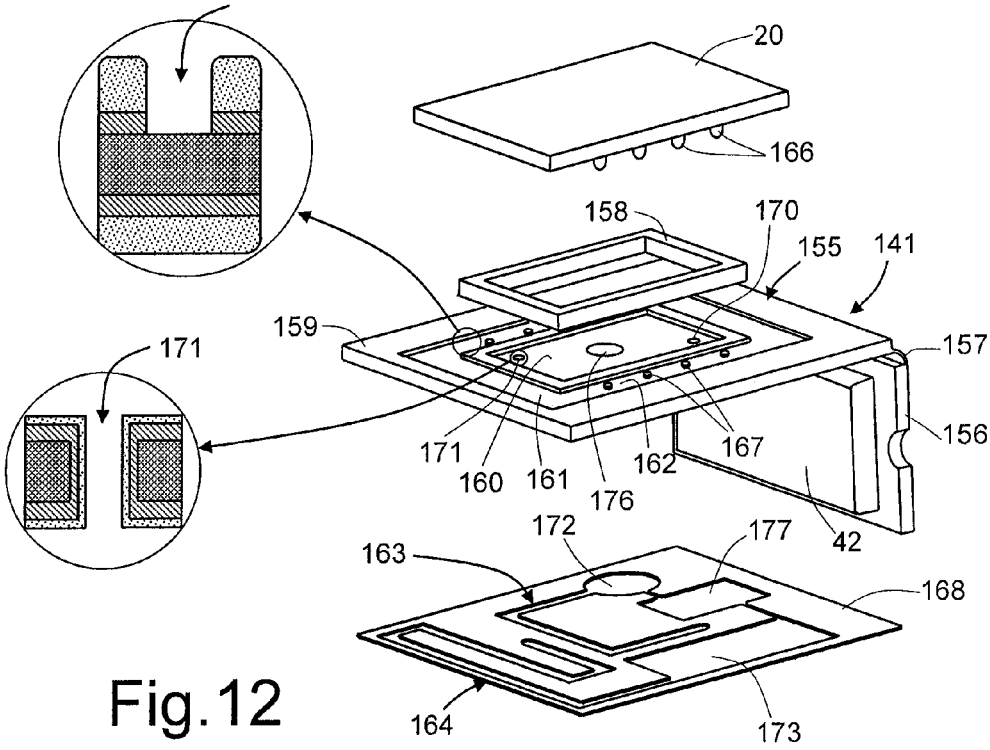
FIG. 12 is an exploded top view of a part of the cartridge of FIG. 10.
Figure 13:
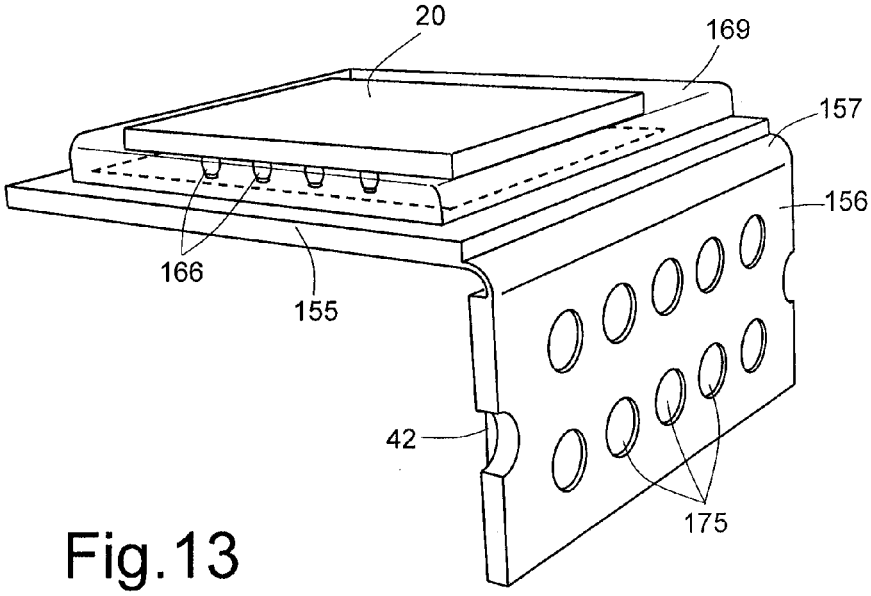
FIG. 13 is an enlarged view of the part of FIG. 12.

In particular (FIG. 12), the top surface of the first board 155 is etched at the center so as to form a lower reaction area 160 and, around this, a bonding lower area 161 separated from one another by an annular protruding area 162 against which a delimitation gasket 158 rests, approximately congruous with the annular protruding area 162 (FIG. 12). A protruding peripheral area 159 surrounds the bonding lower area 161.

The chip 20 is here bonded to the first board 155 via bumps 166 in contact with corresponding contact pads 167 formed in a bonding lower area 161 and connected to respective conductive paths (not illustrated). The chip 20 closes at the top the internal space delimited by the delimitation gasket 158 and delimits, together with this and the lower area of reaction 160, a reaction chamber 165 facing the detecting regions 22 of the cells 1 formed in the chip 20. In this way, the delimitation gasket 158 determines the height of the reaction chamber 165 (e.g., 0.1-0.15 mm) and contributes to its sealing towards the outside. A sealing region 169, obtained, for example, by underfilling, i.e., delivery of an epoxy resin, extends alongside the chip 20, between this and the first board 155, around and in contact with the delimitation gasket 158 so as to contribute to hermetically sealing the reaction chamber 165.

The bottom surface of the first board 155 is also etched so as to form chambers and channels for the injected fluids and co-operates with a sealing mask 168 of perforated resin congruently with the bottom surface of the first board 155 so as to define a first and a second fluidic channels 163, 164 for the sample to be analyzed and for the washing liquid, respectively, and a buffer chamber 177 (FIG. 12). Alternatively, no separate sealing mask 168 is provided, and the fluidic channels 163, 164 and the buffer chamber 177 may be formed only in a resin or silicone material layer or, in general, an adhesive, formed on the bottom side of the first board 155.

In detail, the first fluidic channel 163 has a first widened end 172 at the top chamber 148 (FIG. 16) and a second end at a through hole 170 that extends through the first board 155, so as to connect the first feeding hole 150 to the reaction chamber 165. The second fluidic channel 164 has a first widened end 173 at the top chamber 149 and a second end at a through hole 171 that extends through the first board 155 so as to connect the second feeding hole 152 to the reaction chamber 165. The fluidic channels 163, 164 may have a minimum width of 100 μm and a minimum thickness of 50 μm.

The first widened ends 172 and 173 of the fluidic channels 163, 163 are connected, via extremely thin channels, to the buffer chamber 177 to enable venting of the air in the fluidic channels 163 and 164 during filling with the fluid to be analyzed or the washing liquid.

Moreover, the first board 155 has at the center a membrane diaphragm 176, vertically aligned with the through connection hole 183. The membrane diaphragm 176 may be formed in the same way as the membrane diaphragm 76 of the embodiment of FIGS. 4-9. Alternatively, the first board 155 may have a through hole, and the sealing of the through connection hole 183 may be guaranteed by just the sealing mask 168 that is to be perforated for discharge of the waste.

As already indicated, conductive regions and paths may be defined on the first board 155. For example, for the membrane diaphragm 176, a path may extend on one side of the membrane diaphragm 176 and be interrupted at the moment of the perforation of the latter. In this way, monitoring of proper opening of the membrane diaphragm 176 is obtained. Furthermore, resistive heating elements (not illustrated) may be formed in the first board 155 in order to control and stabilize the local temperature, for example for heating individual fluidic paths and/or chambers.

The second board 156 carries the interface 42, which faces the second recess 144; conductive paths and vias (not illustrated) connect the interface 42 to the first board 155 and to the chip 20, as well as to connection areas 175 formed on the outwardly facing side of the second board 156 intended to be connected to an external analysis apparatus.

Figure 11:
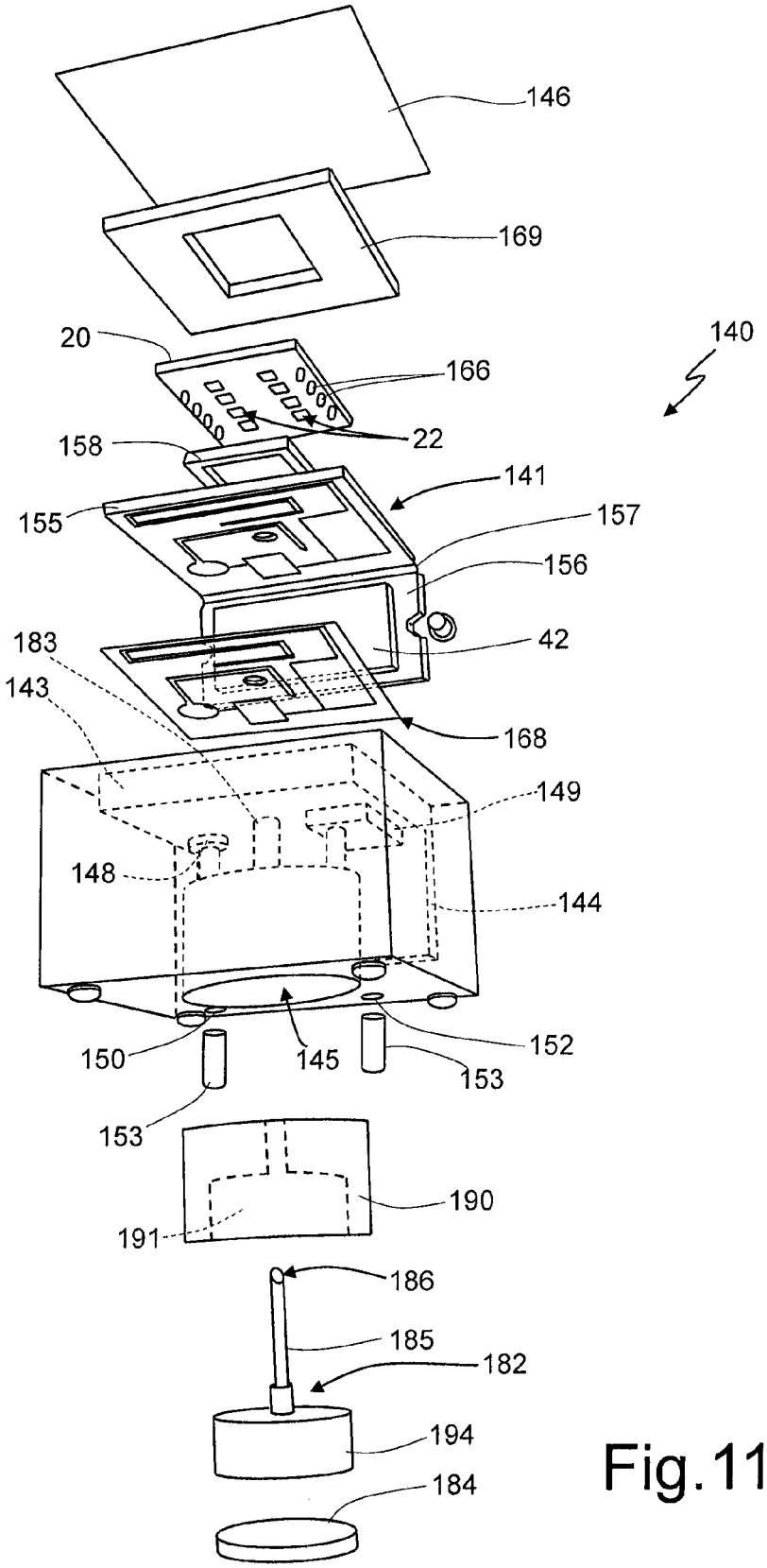
FIG. 11 is an exploded bottom view of the cartridge of FIG. 10.

An actuator group is housed inside the actuator cavity 145 and includes an actuator body 190 and a perforating element 182. The actuator body 190 is counter-shaped to the actuator cavity 145, protrudes slightly downwards from the latter, and defines a seat 191 for the perforating element 182 (FIG. 11). The actuator body 190 is fixed to a perforating element 182, which here also forms a waste reservoir. In detail, the perforating element 182 comprises a base 194 and a hollow shaft 185, protruding from the base 194 and cut obliquely at its top end so as to form a perforating tip 186. The base 194 is hollow and forms inside a waste chamber 180, closed at the bottom by an actuator button 184 and in communication with the inside of the hollow shaft 185.

A ring 192 of elastic material or of a low-elastic modulus material extends between the guide wall 181 and the base 194 so as to normally keep the perforating element 182 and in particular the perforating tip 186 at a short distance from the membrane diaphragm 174, but may be elastically squeezed and enable the actuator body 190 to enter the actuator cavity 145 and perforate the membrane diaphragm 174 in case of an outside pressure exerted by an operator or automatically.

The cartridge 35, 135 here described have the following advantages.

It is formed by a closed module, which limits or substantially prevents the risk of contamination of the fluids introduced into the cartridge, and thus also the crossed interference between substances and samples contained in two or more modules present in a same laboratory. This enables its use in the so-called "points-of-care", i.e., small laboratories distributed in service points with a high flow of people, such as airports, railway and bus stations, service centers, etc., without any need for highly skilled staff.

The introduced liquids remain within the cartridge and thus there are no problems of contamination towards the outside.

In the embodiment of FIGS. 4-9, the displacement of the liquids prevalently in a vertical direction enables exploitation of the gravity and simplification of the operations of transport, at the cost of a greater encumbrance.

Instead, in the embodiment of FIGS. 10-16, the cartridge 135 enables integration of all the fluidic and electronic structures in a small space.

Both the solutions enable very precise control of the volumes of the introduced fluids, as well as of the local thermal variations.

The fluid obtained from mixing the sample and the reagents may remain contained in the reaction chamber 65, 165 for the entire time envisaged for completion of the reaction step and only subsequently be washed away by the washing liquid for completion of the analyses, thanks to the manual or mechanical perforation of the membrane diaphragm 76, 176. This enables optimization of the procedures according to the analyses desired.

The reaction chamber 65, 165 is sized so as to be able to contain the volume of liquid for proper development of the reaction, with optimization of the spaces and reduction of the production and warehousing costs.

The thermal resistance RTH of the casing enables easy thermostatting of the reaction chamber 65, 165, and the presence of heaters and temperature sensors 31, 30 integrated in the chip 20 (FIG. 3) and/or on the supporting element 41, 141 enables temperature cycles to be managed in an optimal way.

The supporting element 41, 141 operates as mechanical support and electrical interface and contributes to the fluid tightness.

In the embodiment of FIGS. 4-9, the sealing effect is obtained exclusively by mechanically clamping the various layers 45-48 and the substrate 41, favored by the material of the casing 40, by the presence of gaskets (for example, the gaskets 72, 77) obtained simply and at a low cost with methods and materials typical of printed circuits, and by the use of the breakable plugs 53 of self-sealing material.

In the embodiment of FIGS. 10-16, the sealing effect is even more simplified thanks to the monolithic construction of the casing 140.

Aeration holes enable entry and displacement of the fluids within the cartridge 65, 165.

The dimensions of the reaction chamber 65, 165 may be adapted easily in the design stage by adapting the dimensions of the gasket 72 and of the protrusion 66, or else of the annular protruding area 162 and of the delimitation gasket 158.

The cartridge 35, 135, which is of a disposable type, prevents any erroneous reuse since the presence of the liquids of the first reaction prevents introduction of new samples and/or washing liquids, and the perforation of the membrane diaphragm 76, 176 causes immediate discharge into the waste chamber 80, 180 of possible reagents introduced by mistake, thus preventing these reagents introduced by mistake into the reaction chamber 65, 165 from possibly remaining there.

In both the solutions, the cartridges 35, 135 may be manufactured easily by mass production, via molding and hermetic sealing with resins.

The cartridges 35, 135 may be connected to an external analysis apparatus 200, described, for example, in the aforementioned U.S. patent application Ser. No. 12/649,019 and illustrated in FIG. 17.

According to FIG. 17, the apparatus 200 comprises a processing unit 203, a power generator 204 controlled by the processing unit 203, a display 205, a reader 208, and a cooling unit 206. The cartridge 35, 135 may be removably inserted into the reader 208 for selective coupling to the processing unit 203 and to the power generator 204. The heaters 31 and further possible heaters provided in the casing 40, 140 are coupled to the power generator 204 through the interface 42. The cooling unit 206 may be a Peltier module or a fan, controlled by the processing unit 203 and thermally coupled to the cartridge 35, 135 when inserted in the reader 208.

Finally, it is clear that modifications and variations may be made to the cartridge described and illustrated herein, without thereby departing from the scope of the present disclosure.

For example, in the embodiment of the cartridge 135 of FIGS. 10-16, in order to facilitate movement of the injected fluids, it is possible to provide ceramic piezoelectric membranes to form micropumps, for example of the type described in the article "A High-Performance Silicon Micropump for Fuel Handling in DMFC Systems" by M. Richter, J. Kruckow, A. Drost, Fuel Cell Seminar, Nov. 3-7, proceedings, Miami Beach, Fla., USA, 2003, pp. 272-275, or silicon micropumps of the type described in EP 1403383, for sucking the liquids within the feeding holes 150, 152 and the fluidic channels 163, 164.

Possibly, the micropumps could be provided also in the cartridge 35.

The breakable plugs 53, 153 of self-sealing material may be replaced by hermetic valves of a different type.

The form of the actuator device in the two embodiments may be exchanged so as to provide the waste chamber in the perforating element 82 illustrated in FIGS. 4-9 or directly inside the casing 140 in the embodiment of FIGS. 10-16.

The various embodiments described above can be combined to provide further embodiments. All of the U.S. patents, U.S. patent application publications, U.S. patent application, foreign patents, foreign patent application and non-patent publications referred to in this specification are incorporated herein by reference, in their entirety. Aspects of the embodiments can be modified, if necessary to employ concepts of the various patents, application and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A fluidic cartridge for detecting chemicals in samples, comprising:

an integrated device having a plurality of detecting regions configured to bind to target chemicals;

an interface unit electrically coupled to the integrated device and including a signal processing stage and external contact regions;

a supporting element carrying the integrated device and the interface unit;

a reaction chamber facing the detecting regions;

fluidic paths coupled to the reaction chamber;

a waste reservoir;

a valve selectively coupling the waste reservoir to the reaction chamber; and a casing hermetically housing part of the supporting element with the integrated device, the reaction chamber, the fluidic paths, the waste reservoir, and the valve, the casing including:

a sample feeding hole and a washing feeding hole, the sample feeding hole and the washing feeding hole being coupled to the reaction chamber by the fluidic paths; and first and second closures respectively closing the sample feeding hole and the washing feeding hole, wherein:

the integrated device is fixed to a first side of the supporting element, the waste reservoir is arranged on a second side of the supporting element, and the valve comprises a weakened area of the supporting element and a perforating element extending in the casing on the second side of the supporting element and having a perforating tip, the perforating element being in fluidic connection with the waste reservoir and being actuatable between a rest configuration and a perforating configuration, wherein the rest configuration is a configuration in which the perforating tip extends at a distance from the weakened area, and the perforating configuration is a configuration in which the perforating element extends through the weakened area and provides a fluid connection between the reaction chamber and the waste reservoir.

2. A fluidic cartridge according to claim 1, wherein the perforating element comprises an actuation base exposed to an outside of the casing and movable or deformable following a thrust action from the outside, and a hollow shaft extending from the actuation base and ending with the perforating tip.

3. A fluidic cartridge according to claim 2, wherein the waste reservoir includes a waste chamber formed in the casing, the hollow shaft of the perforating element having an opening connecting an interior of the hollow shaft to the waste chamber.

4. A fluidic cartridge according to claim 3, wherein the actuation base is of deformable material and is fixed to the hollow shaft.

5. A fluidic cartridge according to claim 2, wherein the waste reservoir comprises a waste chamber formed in an interior of the actuation base and in fluidic connection with an interior of the hollow shaft.

6. A fluidic cartridge according to claim 1, wherein the first and second closures are breakable, self-sealing plugs.

7. A fluidic cartridge for detecting chemicals in samples, comprising:

an integrated device having a plurality of detecting regions configured to bind to target chemicals;

an interface unit electrically coupled to the integrated device and including a signal processing stage and external contact regions;

a supporting element carrying the integrated device and the interface unit;

a reaction chamber facing the detecting regions;

fluidic paths coupled to the reaction chamber;

a waste reservoir;

a valve selectively coupling the waste reservoir to the reaction chamber; and a casing hermetically housing part of the supporting element with the integrated device, the reaction chamber, the fluidic paths, the waste reservoir, and the valve, the casing including:

a sample feeding hole and a washing feeding hole, the sample feeding hole and the washing feeding hole being coupled to the reaction chamber by the fluidic paths; and first and second closures respectively closing the sample feeding hole and the washing feeding hole, wherein:

the casing comprises a plurality of superimposed layers, including a covering layer, a fluidic layer, a bearing layer, and a closing layer;

the covering layer includes the sample feeding hole and the washing feeding hole;

the fluidic layer has a first side and a second side, the first side facing the covering layer and defining the fluidic paths and the second side facing the bearing layer and defining the reaction chamber;

the reaction chamber has a bottom closed by the bearing layer;

through holes extend through the fluidic layer between the fluidic paths and the reaction chamber;

the bearing layer defines, together with the closing layer and the fluidic layer, a seat for the valve and the waste reservoir; and the supporting element is clamped between the fluidic layer and the bearing layer.

8. A fluidic cartridge according to claim 7, wherein:

the second side of the fluidic layer has a protrusion accommodating the reaction chamber, the bearing layer has a cavity facing and countershaped to the protrusion, and the protrusion has a height equal to a depth of the cavity less a thickness of the supporting element.

9. A fluidic cartridge for detecting chemicals in samples, comprising:

an integrated device having a plurality of detecting regions configured to bind to target chemicals;

an interface unit electrically coupled to the integrated device and including a signal processing stage and external contact regions;

a supporting element carrying the integrated device and the interface unit;

a reaction chamber facing the detecting regions;

fluidic paths coupled to the reaction chamber;

a waste reservoir;

a valve selectively coupling the waste reservoir to the reaction chamber; and a casing hermetically housing part of the supporting element with the integrated device, the reaction chamber, the fluidic paths, the waste reservoir, and the valve, the casing including:

a sample feeding hole and a washing feeding hole, the sample feeding hole and the washing feeding hole being coupled to the reaction chamber by the fluidic paths; and first and second closures respectively closing the sample feeding hole and the washing feeding hole, wherein:

the casing comprises:

a monolithic body having a generally parallelepiped shape, the monolithic body having first and second surfaces opposite to one another, a first recess in the first surface of the monolithic body; and an actuator cavity in the second surface of the monolithic body; the supporting element and integrated device being positioned in the first recess; and a cover body covering the first recess;

the valve is positioned in the actuator cavity;

the sample feeding hole and the washing feeding hole extend from the second surface of the monolithic body, laterally to the actuator cavity, until the first recess; and the supporting element comprises a first board resting on a bottom of the first recess and the integrated device is fixed to a first side of the first board, the reaction chamber being positioned between the first side of the first board and the integrated device, the fluidic cartridge comprising a sealing structure extending between the first board and the integrated device and laterally sealing the reaction chamber.

10. A fluidic cartridge according to claim 9, wherein the first board includes:

a second side facing a bottom of the first recess and including the fluidic paths; and through holes connecting the fluidic channels to the reaction chamber.

11. A fluidic cartridge according to claim 10, comprising a sealing layer arranged between the first board and the bottom of the first recess, the sealing layer being of a material selected among resin, silicone-based material and adhesive and being shaped congruently to the second side of the first board.

12. A fluidic cartridge according to claim 9, wherein the first side of the first board includes a protruding annular area, an inner lower area, and a bonding lower area surrounding the protruding annular area, the protruding annular area separating the inner lower area from the bonding lower area, the fluidic cartridge further comprising:

a first sealing element cooperating with the protruding annular area; and a second sealing element surrounding the integrated device, the first sealing element and the first board.

13. A fluidic cartridge according to claim 9, wherein the monolithic body has a second recess extending in a side surface of the monolithic body, transversely to the first recess, the fluidic cartridge comprising:

a second board elastically and electrically connected to the first board; the second board having a first side carrying the interface unit and having a second side that includes electric contact regions.

14. A fluidic cartridge for detecting chemicals in samples, comprising:

an integrated device having a plurality of detecting regions configured to bind to target chemicals;

a reaction chamber facing the detecting regions;

fluidic paths coupled to the reaction chamber and a waste reservoir;

a valve selectively coupling the waste reservoir to the reaction chamber; and a casing hermetically housing the integrated device, the reaction chamber, the fluidic paths, the waste reservoir, and the valve, the casing including:

a sample feeding hole and a washing feeding hole, the sample feeding hole and the washing feeding hole being coupled to the reaction chamber by the fluidic paths; and a first closure and a second closure respectively covering the sample feeding hole and the washing feeding hole, wherein:

the valve includes a membrane diaphragm positioned between the reaction chamber and the waste reservoir and a perforating element having a perforating tip, the perforating element being in fluidic connection with the waste reservoir and being actuatable between a rest configuration and a perforating configuration, the rest configuration being a configuration in which the perforating tip extends at a distance from the membrane diaphragm and the perforating configuration being a configuration in which the perforating element extends through the membrane diaphragm and provides a fluid connection between the reaction chamber and the waste reservoir;

the perforating element comprises an actuation base, exposed to an outside of the casing and configured to move in response to a thrust action from the outside, and a hollow shaft extending from the actuation base and ending with the perforating tip; and the waste reservoir comprises a waste chamber formed in an interior of the actuation base and in fluidic connection with an interior of the hollow shaft.

15. A fluidic cartridge according to claim 14, wherein the hollow shaft of the perforating element has an opening connecting an interior of the hollow shaft to the waste chamber.

16. A fluidic cartridge according to claim 14, wherein the first closure and the second closure are breakable, self-sealing plugs.

17. A fluidic cartridge according to claim 14, wherein the first and second closures are breakable, self-sealing plugs.

18. A fluidic cartridge according to claim 14, further comprising:

an interface unit electrically coupled to the integrated device and including a signal processing stage;

a first board supporting the integrated device, the reaction chamber being positioned between the first board and the integrated device; and a second board mechanically and electrically connected to the first board; the second board having a first side carrying the interface unit and a second side that includes electric contact regions exposed externally of the fluidic cartridge.

* * * * *

UNITED STATES PATENT AND TRADEMARK OFFICE

CERTIFICATE OF CORRECTION

PATENT NO. : 9,180,451 B2
APPLICATION NO. : 13/170058
DATED : November 10, 2015
INVENTOR(S) : Federico Giovanni Ziglioli et al.

It is certified that error appears in the above-identified patent and that said Letters Patent is hereby corrected as shown below:

In The Claims

Column 16, Lines 14-16:
"16. A fluidic cartridge according to claim 14, wherein the first closure and the second closure are breakable, self-sealing plugs." should read, --16. A fluidic cartridge according to claim 15, where the actuation base is of deformable material and is fixed to the hollow shaft.--.

Column 16, Line 18:
"first and second closures are breakable, self-sealing plugs." should read, --first closure and the second closure are breakable, self-sealing plugs.--.

Signed and Sealed this
Twenty-third Day of August, 2016

Michelle K. Lee

Michelle K. Lee
*Director of the United States Patent and Trademark Office*